US009406998B2

(12) United States Patent
Korva et al.

(10) Patent No.: US 9,406,998 B2
(45) Date of Patent: Aug. 2, 2016

(54) DISTRIBUTED MULTIBAND ANTENNA AND METHODS

(75) Inventors: Heikki Korva, Tupos (FI); Petteri Annamaa, Oulunsalo (FI); Ari Raappana, Kello (FI)

(73) Assignee: Pulse Finland OY (FI)

( * ) Notice: Subject to any disclaimer, the term of this patent is extended or adjusted under 35 U.S.C. 154(b) by 1199 days.

(21) Appl. No.: 12/764,826

(22) Filed: Apr. 21, 2010

(65) Prior Publication Data

US 2011/0260939 A1 Oct. 27, 2011

(51) Int. Cl.

| | |
|---|---|
| ***H01Q 21/00*** | (2006.01) |
| ***H01Q 1/38*** | (2006.01) |
| ***H01Q 1/24*** | (2006.01) |
| ***H01Q 9/04*** | (2006.01) |
| ***H01Q 9/42*** | (2006.01) |
| ***H01Q 21/30*** | (2006.01) |
| ***H01Q 5/357*** | (2015.01) |
| ***H01Q 5/378*** | (2015.01) |

(52) U.S. Cl.

CPC ..... *H01Q 1/243* (2013.01); *H01Q 5/357* (2015.01); *H01Q 5/378* (2015.01); *H01Q 9/0421* (2013.01); *H01Q 9/42* (2013.01); *H01Q 21/30* (2013.01)

(58) Field of Classification Search

USPC ..... 343/725

See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |

(Continued)

FOREIGN PATENT DOCUMENTS

| | | |
|---|---|---|
| CN | 1316797 | 10/2007 |
| DE | 10015583 | 11/2000 |

(Continued)

OTHER PUBLICATIONS

"Impedance and Admittance," Basic Engineering Circuit Analysis, 7th Edition, a Wiley First Edition, Irwin, John, Wiley and Sons, 2002.*

(Continued)

*Primary Examiner* — Graham Smith

(74) *Attorney, Agent, or Firm* — Gazdzinski & Associates PC

(57) ABSTRACT

A distributed multiband antenna intended for radio devices, and methods for designing manufacturing the same. In one embodiment, a planar inverted-F antenna (PIFA) configured to operate in a high-frequency band, and a matched monopole configured to operate in a low-frequency band, are used within a handheld mobile device (e.g., cellular telephone). The two antennas are placed on substantially opposing regions of the portable device. The use of a separate low-frequency antenna element facilitates frequency-specific antenna matching, and therefore improves the overall performance of the multiband antenna. The use of high-band PIFA reduces antenna volume, and enables a smaller device housing structure while also reducing signal losses in the high frequency band. These attributes also advantageously facilitate compliance with specific absorption rate (SAR) tests; e.g., in the immediate proximity of hand and head "phantoms" as mandated under CTIA regulations. Matching of the low-frequency band monopole antenna is further described.

24 Claims, 11 Drawing Sheets

(56) References Cited

U.S. PATENT DOCUMENTS 4,054,874 A 10/1977 Oltman
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,862,181 A 8/1989 PonceDeLeon et al.
4,879,533 A 11/1989 De Muro et al.
4,896,124 A 1/1990 Schwent
4,954,796 A 9/1990 Green et al.
4,965,537 A 10/1990 Kommrusch
4,977,383 A 12/1990 Niiranen
4,980,694 A 12/1990 Hines
5,017,932 A 5/1991 Ushiyama et al.
5,047,739 A 9/1991 Kuokkanen
5,053,786 A 10/1991 Silverman et al.
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,517,683 A 5/1996 Collett et al.
5,521,561 A 5/1996 Yrjola
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 9/1997 Perrotta et al.
5,675,301 A 10/1997 Nappa
5,689,221 A 11/1997 Niiranen
5,694,135 A 12/1997 Dikun et al.
5,703,600 A 12/1997 Burrell et al.
5,709,832 A 1/1998 Hayes
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A * 8/1998 Tsuru ..... H01Q 1/243 343/751
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen

(56) References Cited

U.S. PATENT DOCUMENTS 6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,112,108 A 8/2000 Tsubaki et al.
6,133,879 A 10/2000 Grangeat et al.
6,134,421 A 10/2000 Lee et al.
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 * 9/2002 Johnson et al. ..... 343/702
6,459,413 B1 10/2002 Tseng et al.
6,462,716 B1 10/2002 Kushihi
6,469,673 B2 10/2002 Kaiponen
6,473,056 B2 10/2002 Annamaa
6,476,769 B1 11/2002 Lehtola
6,480,155 B1 11/2002 Eggleston
6,501,425 B1 12/2002 Nagumo
6,518,925 B1 2/2003 Annamaa
6,529,168 B2 3/2003 Mikkola
6,535,170 B2 3/2003 Sawamura et al.
6,538,604 B1 3/2003 Isohatala
6,549,167 B1 4/2003 Yoon
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka et al.
6,603,430 B1 8/2003 Hill et al.
6,606,016 B2 8/2003 Takamine et al.
6,611,235 B2 8/2003 Barna et al.
6,614,400 B2 9/2003 Egorov
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 * 11/2004 Sullivan et al. ..... 343/700 MS
6,819,293 B2 11/2004 De Graauw et al.
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,792 B1 8/2005 Mimura et al.
6,937,196 B2 8/2005 Korva
6,950,066 B2 9/2005 Hendler et al.
6,950,068 B2 9/2005 Bordi
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos

(56) References Cited

U.S. PATENT DOCUMENTS

| | | | |
|---|---|---|---|
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva |
| 7,358,902 | B2 | 4/2008 | Erkocevic |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,468,700 | B2 | 12/2008 | Milosavljevic |
| 7,468,709 | B2 | 12/2008 | Niemi |
| 7,498,990 | B2 | 3/2009 | Park et al. |
| 7,501,983 | B2 | 3/2009 | Mikkola |
| 7,502,598 | B2 | 3/2009 | Kronberger |
| 7,589,678 | B2 | 9/2009 | Perunka |
| 7,616,158 | B2 | 11/2009 | Mark et al. |
| 7,633,449 | B2 | 12/2009 | Oh |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,889,139 | B2 | 2/2011 | Hobson et al. |
| 7,889,143 | B2 | 2/2011 | Milosavljevic |
| 7,901,617 | B2 | 3/2011 | Taylor |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,179,322 | B2 | 5/2012 | Nissinen |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2005/0226353 | A1* | 10/2005 | Gebara ..... H01Q 1/521 375/346 |
| 2006/0017621 | A1* | 1/2006 | Okawara et al. ..... 343/700 MS |
| 2006/0071857 | A1 | 4/2006 | Pelzer |
| 2006/0071864 | A1* | 4/2006 | Richard et al. ..... 343/702 |
| 2006/0192723 | A1 | 8/2006 | Harada |
| 2007/0042615 | A1 | 2/2007 | Liao |
| 2007/0082789 | A1 | 4/2007 | Nissila |
| 2007/0152881 | A1 | 7/2007 | Chan |
| 2007/0188388 | A1 | 8/2007 | Feng |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0266199 | A1 | 10/2008 | Milosavljevic |
| 2009/0009415 | A1 | 1/2009 | Tanska |
| 2009/0135066 | A1 | 5/2009 | Raappana et al. |
| 2009/0174604 | A1 | 7/2009 | Keskitalo |
| 2009/0196160 | A1 | 8/2009 | Crombach |
| 2009/0197654 | A1 | 8/2009 | Teshima |
| 2009/0231213 | A1 | 9/2009 | Ishimiya |
| 2010/0220016 | A1 | 9/2010 | Nissinen |
| 2010/0244978 | A1 | 9/2010 | Milosavljevic |
| 2010/0309092 | A1 | 12/2010 | Lambacka |
| 2011/0102290 | A1 | 5/2011 | Milosavljevic |
| 2011/0133994 | A1 | 6/2011 | Korva |
| 2012/0119955 | A1 | 5/2012 | Milosavljevic |

FOREIGN PATENT DOCUMENTS

| | | | |
|---|---|---|---|
| DE | 10104862 | | 8/2002 |
| DE | 101 50 149 | A1 | 4/2003 |
| EP | 0208424 | | 1/1987 |
| EP | 0278069 | | 8/1988 |
| EP | 0279050 | | 8/1988 |
| EP | 0339822 | | 3/1989 |
| EP | 0 332 139 | | 9/1989 |
| EP | 0 376 643 | A2 | 4/1990 |
| EP | 0383292 | | 8/1990 |
| EP | 0399975 | | 12/1990 |
| EP | 0400872 | | 12/1990 |
| EP | 0401839 | | 9/1991 |
| EP | 0447218 | | 9/1994 |
| EP | 0615285 | | 10/1994 |
| EP | 0621653 | | 2/1995 |
| EP | 0 749 214 | | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0766339 | | 2/1999 |
| EP | 0 942 488 | A2 | 9/1999 |
| EP | 1 003 240 | A2 | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 0999607 | | 10/2000 |
| EP | 1 052 723 | | 11/2000 |
| EP | 1052722 | | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1113524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1162688 | | 12/2001 |
| EP | 0993070 | | 4/2002 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1306922 | | 5/2003 |
| EP | 1 329 980 | | 7/2003 |
| EP | 1 351 334 | | 8/2003 |

(56) References Cited

FOREIGN PATENT DOCUMENTS

| | | | |
|---|---|---|---|
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |
| EP | 1 445 822 | | 8/2004 |
| EP | 1 453 137 | | 9/2004 |
| EP | 1 469 549 | | 10/2004 |
| EP | 1220456 | | 10/2004 |
| EP | 1467456 | | 10/2004 |
| EP | 1 482 592 | | 12/2004 |
| EP | 1 498 984 | | 1/2005 |
| EP | 1 564 839 | | 1/2005 |
| EP | 1170822 | | 4/2005 |
| EP | 1 544 943 | | 6/2005 |
| EP | 1753079 | | 2/2007 |
| EP | 1 791 213 | | 5/2007 |
| EP | 1 806 907 | A1 | 7/2007 |
| EP | 1843432 | | 10/2007 |
| EP | 2 237 129 | A2 | 10/2010 |
| FI | 20020829 | | 11/2003 |
| FR | 2553584 | | 10/1983 |
| FR | 2724274 | | 3/1996 |
| FR | 2873247 | | 1/2006 |
| GB | 2266997 | | 11/1993 |
| GB | 2 360 422 | A | 9/2001 |
| GB | 239246 | | 12/2003 |
| JP | 1984202831 | | 11/1984 |
| JP | 600206304 | | 10/1985 |
| JP | 1986245704 | | 11/1986 |
| JP | 06152463 | | 5/1994 |
| JP | 1995131234 | | 5/1995 |
| JP | 1995221536 | | 8/1995 |
| JP | 7249923 | | 9/1995 |
| JP | 1995307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10 028013 | | 1/1998 |
| JP | 10107671 | | 4/1998 |
| JP | 10173423 | | 6/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11 004117 | | 1/1999 |
| JP | 1999004113 | | 1/1999 |
| JP | 11 068456 | | 3/1999 |
| JP | 11127010 | | 5/1999 |
| JP | 11136025 | | 5/1999 |
| JP | 199127014 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 200 326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003/24730 | | 4/2003 |
| JP | 2003179426 | | 6/2003 |
| JP | 2003318638 | | 11/2003 |
| JP | 2004 040596 | | 2/2004 |
| JP | 2004112028 | | 4/2004 |
| JP | 2004363859 | | 12/2004 |
| JP | 2005005985 | | 1/2005 |
| JP | 2005252661 | | 9/2005 |
| KR | 20010080521 | | 10/2001 |
| KR | 10-2006-7027462 | | 12/2002 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 98/01921 | | 1/1998 |
| WO | WO 98/37592 | | 8/1998 |
| WO | WO 99/30479 | | 6/1999 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/008672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067375 | | 8/2002 |
| WO | WO 02/078123 | | 10/2002 |
| WO | WO 02/078124 | | 10/2002 |
| WO | WO 03/094290 | | 11/2003 |
| WO | WO 2004/017462 | | 2/2004 |
| WO | WO 2004/036778 | | 4/2004 |
| WO | WO 2004/057697 | | 7/2004 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |
| WO | WO 2010/122220 | | 10/2010 |

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE*

(56) References Cited

OTHER PUBLICATIONS

*Antennas and Wireless Propagation Letters*, vol. 2, 226-229, 2003.
C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.
Cheng- Nan Hu, Willey Chen, and Book Tai, "A Compact Multi-Band Antenna Design for Mobile Handsets", *APMC 2005 Proceedings*.
Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.
European Office Action, May 30, 2005 issued during prosecution of EP 04 396 001.2-1248.
Examination Report dated May 3, 2006 issued by the EPO for European Patent Application No. 04 396 079.8.
F.R. Hsiao, et al. "A dual-band planar inverted-F patch antenna with a branch-line slit," *Microwave Opt. Technol. Lett.*, vol. 32, Feb. 20, 2002.
Griffin, Donald W. et al, "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.
Guo, Y. X. and H. S. Tan, "New compact six-band internal antenna," *IEEE Antennas and Wireless Propagation Letters*, vol. 3, 295-297, 2004.
Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.
Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hosse, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X, Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1858, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications.*, Hoboken, NJ; Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted 11/04 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. 2003, vol. 51, No. 1.
X.-D. Cal and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi Kumar, et al. "Broadband Concentric Rings Fractal Slot Antenna," Department of Electrical Engineering, Indian Institute of Technology, Kanpur-208 016, India.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Anson Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for European Patent Application No. 12177740.3.

* cited by examiner

DISTRIBUTED MULTIBAND ANTENNA AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to antennas for use in wireless or portable radio devices, and more particularly in one exemplary aspect to a spatially distributed multiband antenna, and methods of utilizing the same.

DESCRIPTION OF RELATED TECHNOLOGY

Internal antennas are an element found in most modern radio devices, such as mobile computers, mobile phones, Blackberry® devices, smartphones, personal digital assistants (PDAs), or other personal communication devices (PCD). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used.

Internal antennas are commonly constructed to comprise at least a part of a printed wired board (PWB) assembly, also commonly referred to as the printed circuit board (PCB). One antenna type that is commonly used in wireless applications is the inverted-F antenna (IFA).

Planar Inverted-F Antenna

The inverted-F antenna is a variant of the monopole, wherein the top section has been folded down so as to be parallel with the ground plane. This is typically done to reduce the size of the antenna while maintaining a resonant trace length. Planar inverted-F antenna (PIFA) is a variation of linear inverted-F antenna, wherein the wire radiator element is replaced by a plate to expand the antenna operating bandwidth. A typical planar inverted-F antenna 100 in accordance with prior art, shown in FIG. 1A, includes a rectangular planar element 110 (also referred to as the "upper arm") located above a ground plane 102, and a short circuiting plate or pin 104 that connects the top plate 110 to the ground point 114. The feed structure 106 is placed from the ground plane feed point 116 to the planar element 100 of the PIFA.

FIG. 1B shows a top elevation view of the PIFA structure 130, wherein the antenna elements are arranged in a coplanar fashion as during fabrication. To the left of the feed point 116 (as shown in FIG. 1B), the upper planar element is shorted to the ground plane 102. The feed point 116 is closer to the shorting pin 104 than to the open end of the upper plane element 118. The fabrication-stage antenna structure 130 shown in FIG. 1B is bent at locations 120 to produce functional PIFA configuration 100 shown in FIG. 1A.

The optimal length of an ideal inverted-F antenna radiating element is a quarter of a wavelength λ that corresponds to the operating center frequency $f_0$. However, the size of the PIFA planar element 110 (length L 108 and width W 118) is commonly chosen such that:

$$L+W=\lambda/4 \qquad \text{Eqn. (1)}$$

and therefore is inversely proportional to the operating frequency $f_o$ $$f_0 = \frac{c}{2L\sqrt{\varepsilon_r}}. \qquad \text{Eqn. (2)}$$

Here, c is the speed of light and $\in_r$ is dielectric permittivity of the substrate material. Typically, the width of the ground plane 114 matches the PIFA length 108, and the ground plane length 112 is approximately one quarter-wavelength. When the width of the ground plane is smaller than a quarter-wavelength, the bandwidth and efficiency of the PIFA decrease. Hence, typically inverted-F antennas require printed circuit board (PCB) ground plane length is roughly one quarter (λ/4) of the operating wavelength The height of the PIFA 101 above the ground plane is commonly a fraction of the wavelength. Therefore, PIFA operating at lower frequencies require taller antenna configuration that in turn increase the thickness of the radio device body assembly. The radiation properties and impedance of PIFA are not a strong function of the height. This parallel section introduces capacitance to the input impedance of the antenna, which is compensated by implementing a short-circuit stub. The end of the stub is connected to the ground plane through a via (not shown). The polarization of PIFA shown in FIG. 1A is vertical, and the radiation pattern resembles the shape of a 'donut', with the main axis oriented vertically.

As the operating frequency decreases, the PIFA antenna size increases according to Eqn. (2) in order to maintain operating efficiency. Therefore, a multi-band (e.g., dual-band) PIFA, operating in both upper and lower bands, requires a larger volume and height in order to meet the lower-band frequency requirements typical of mobile communications (e.g., 800-900 MHz). To reduce the size of mobile devices operating at these lower frequencies, ordinary monopole antennas are commonly used instead of a PIFA.

Several methods may used to control the PIFA resonance frequency, include, inter alia, (i) the use of open slots that reduce the frequency, (ii) altering the width of the planar element, and/or (iii) altering the width of the short circuit plate of the PIFA. For instance, resonant frequency decreases with a decrease in short circuit plate width.

One method of reducing PIFA size is simply by shortening the antenna. However, this requires the use of capacitive loading to compensate for the reactive component of the impedance that arises due to the shortened antenna structure. Capacitive loading allows reduction in the resonance length from λ/4 to less than λ/8, at the expense of bandwidth and good matching (efficiency). The capacitive load can be produced for example by adding a plate (parallel to the ground) to produce a parallel plate capacitor.

One of the substantial limitations of PIFA for wireless commercial applications is its narrow bandwidth. Various techniques are typically used to increase PIFA bandwidth such as, inter alia, reducing the size of the ground plane, adjusting the location and the spacing between two shorting posts, reducing the quality factor of the resonator structure (and to increase the bandwidth), utilizing stacked elements, placing slits at the ground plane edges, and use of parasitic resonators with resonant lengths close to the main resonance frequency.

The ground plane of the PIFA plays a significant role in its operation. Excitation of currents in the PIFA causes excitation of currents in the ground plane. The resulting electromagnetic field is formed by the interaction of the PIFA and an "image" of itself below the ground plane. As a result, a PIFA has significant currents that flow on the undersurface of the planar element and the ground plane, as compared to the field on the upper surface of the element. This phenomenon makes the PIFA less susceptible to interference from external objects (e.g., a mobile device operator's hand/head) that typically affect the performance characteristics of monopole antennas.

Compliance Testing of Wireless Devices

Almost all wireless devices that are offered for sale worldwide are subject to government regulations that mandate specific absorption (SAR) tests to be performed with each radio-emitting device. For example, the CTIA3.0 specification requires SAR measurements with mobile devices to be performed in: (i) free space; and (ii) proximate to a "phantom" head and hand, so as to simulate the real-world operation.

Referring now to FIG. 1C prior art CTIA SAR test configuration 150 with head phantom is shown. The head phantom 152 is constructed to simulate a human head, and features a reference plane 162 contour that passes through the mouth area 160. The mobile device 156 is positioned against the phantom ear area at an angle 164 to the head phantom 152 vertical axis. The mobile device 156 is spaced from the hand phantom 154 by a palm spacer 158. The test angle 164 is typically about 6 degrees.

FIG. 1D depicts a prior art CTIA SAR test configuration 170 for a mobile radio device 156 with a hand phantom 154. According to the CTIA 3.0 setup, the mobile device 156 is positioned along a center axis 176 of the palm spacer 158.

Prior art antenna solutions commonly address the multiband antenna requirements for mobile phones by implementing a single PIFA, or a single monopole antenna configured to operate in multiple frequency bands. This approach inherently has drawbacks, as PIFAs require larger size (height in particular), and hence occupy a large volume to reach the desired lower frequency of multiband operation. While monopole antennas typically perform well in the free space tests, their performance beside the aforementioned phantom head and hand is degraded, particularly at higher frequencies. However, the high-band PIFA antennas usually work better beside the phantom due to a ground plane between the antenna and the phantom.

While the height of a PIFA can be reduced by means of switching circuits, this approach increases complexity and cost. Although monopole antennas are generally smaller than a PIFA, a top-mounted monopole antenna performs poorly in CTIA tests proximate to the head phantom. Similarly, bottom mounted PIFA exhibit poor performance in CTIA tests proximate to the head phantom and hand phantom.

Therefore, based on the foregoing, there is a salient need for an improved multiband wireless antenna for use in mobile phones and other mobile radio devices that have reduced size, lower cost and improved performance in CTIA tests (and methods of utilizing the same).

SUMMARY OF THE INVENTION

The present invention satisfies the foregoing needs by providing, inter alia, a space-efficient multiband antenna and methods of use.

In a first aspect of the invention, a multiband antenna assembly is disclosed. In one embodiment, the assembly has lower and an upper operating frequency bands, and is for use in a mobile radio device. The assembly in this embodiment comprises: a ground plane having a first and a second substantially opposing edges; a monopole antenna configured to operate in a first frequency band and being disposed proximate to the first edge; a planar inverted-F antenna (PIFA) configured to operate in a second frequency band and being disposed proximate to the second edge; and a feed apparatus configured to feed the monopole antenna and the PIFA elements. In one variant, the monopole antenna further comprises: a radiator element formed in a plane substantially perpendicular to the ground plane; a non-conductive slot formed within the radiator element; and a matching circuit. The matching circuit comprises: a feed point; a ground; a stripline coupled from the ground to the feed point; a tuning capacitor coupled to the ground and the stripline; and a feed pad coupled to the stripline via an inductor. The feed pad is further coupled to the radiator element; and the PIFA further comprises: a first planar radiator formed substantially parallel to the ground plane; a parasitic planar radiator formed substantially coplanar to the first planar radiator; a non-conductive slot formed inside within the first planar element; a first feed point coupled from the first planar radiator element to the feed apparatus; a ground point coupled from first planar radiator element to the ground plane; and a parasitic feed point coupled from the parasitic feed point to the ground plane.

In another embodiment, the antenna assembly comprises: a ground plane; a matching circuit comprising: a feed; a ground; a stripline coupled from the ground to the feed point; a feed pad coupled to the stripline via a coupling element; and a radiator element formed in a plane substantially perpendicular to the ground plane. The feed pad is further coupled to the radiator element.

In a second aspect of the invention, antenna apparatus is disclosed. In one embodiment, the apparatus comprises: a ground plane having a first and a second substantially opposing ends; a first antenna element operable in a first frequency band and disposed proximate to the first end; a matching circuit coupled to the first antenna element; a second antenna element configured to operate in an second frequency band and disposed proximate to the second end; and feed apparatus operably coupled to the first and the second antenna elements.

In a third aspect of the invention, a mobile communications device is disclosed. In one embodiment, the device has a multiband antenna apparatus contained substantially therein, and comprises: an exterior housing; a substrate disposed substantially within the housing; a ground plane having a first and a second substantially opposing ends, at least a portion of the ground plane disposed on the substrate; a first antenna element operable in a first frequency band and disposed proximate to the first end; a matching circuit coupled to the first antenna element; a second antenna element configured to operate in an second frequency band and disposed proximate to the second end; feed apparatus operably coupled to the first and the second antenna elements; and at least one radio frequency transceiver in operative communication with the feed apparatus.

In another embodiment, the mobile device comprises a reduced-size mobile radio device operable in a lower and an upper frequency bands. The device comprises an exterior housing and a multiband antenna assembly, the antenna assembly comprising a rectangular ground plane having first and second substantially opposing regions. The mobile radio device being configured according to the method comprising:

placing a first antenna element configured to resonate in the upper frequency band proximate to a the first region; and placing a second antenna element configured to resonate in the lower frequency band proximate to the second region. The first antenna element comprises a planar inverted-F antenna (PIFA); and the act of placing the first antenna element effects reduction of the exterior housing size in at least one dimension.

In a fourth aspect of the invention, a method of operating multi-band antenna assembly is disclosed. In one embodiment, the antenna comprises first, second, and third antenna radiating elements, and at least first, second, and third feed points, the method comprising: selectively electrically coupling the first feed point to the first radiating element via a first circuit; or selectively electrically coupling the second feed point to the second radiating element via a second circuit; and the third feed point to the third radiating element via a third circuit. The first and second circuits effect the antenna assembly to operate in a first frequency band; and the third circuit effect the antenna assembly to operate in a second frequency band.

These and other embodiments, aspects, advantages, and features of the present invention will be set forth in part in the description which follows, and in part will become apparent to those skilled in the art by reference to the following description of the invention and referenced drawings or by practice of the invention.

BRIEF DESCRIPTION OF THE DRAWINGS

The features, objectives, and advantages of the invention will become more apparent from the detailed description set forth below when taken in conjunction with the drawings, wherein.

Figure 1A:
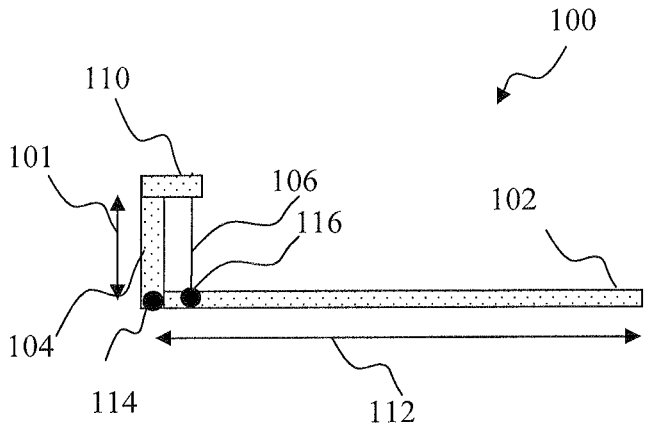
FIG. 1A Prior art
FIG. 1A is a side elevation view of a typical PIFA in operational configuration.
Figure 1B:
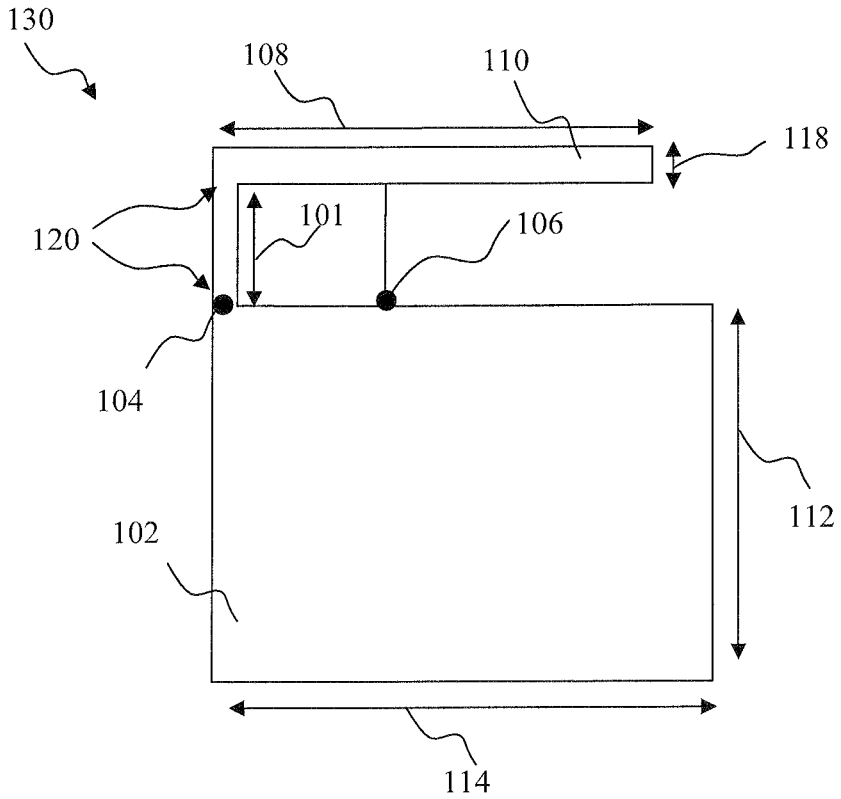
FIG. 1B Prior art
FIG. 1B is a top elevation view showing an intermediate configuration of the PIFA of FIG. 1A.

All Figures disclosed herein are © Copyright 2010 Pulse Finland Oy. All rights reserved.

DETAILED DESCRIPTION OF THE PREFERRED EMBODIMENT

Reference is now made to the drawings wherein like numerals refer to like parts throughout.

The terms "antenna," "antenna system," and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer to without limitation any frequency range for communicating signals. Such signals may be communicated pursuant to one or more standards or wireless air interfaces.

As used herein, the terms "mobile device", "client device", and "end user device" include, but are not limited to, personal computers (PCs) and minicomputers, whether desktop, laptop, or otherwise, set-top boxes, personal digital assistants (PDAs), handheld computers, personal communicators, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "feed," "RF feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems, millimeter wave or microwave systems, optical, acoustic, and infrared (i.e., IrDA).

Overview

The present invention provides, in one salient aspect, an antenna apparatus and mobile radio device with improved CTIA compliance, and methods for tuning and utilizing the same. In one embodiment, the mobile radio device comprises two separate antennas placed towards the opposing edges of the mobile device: (i) a top-mounted PIFA antenna operating in an upper-frequency band; and (ii) a bottom-mounted monopole antenna with matching circuit, for operating in a lower-frequency band.

The two individual antennas are designed to have best available performance in their specific operating band. By utilizing a distributed (i.e., substantially separated) antenna structure, the volume needed for the low-band antenna is reduced, while better performance (e.g., compliance with CTIA 3.0 specifications) is achieved at higher frequencies.

In one implementation, each antenna utilizes a separate feed. In an alternate embodiment, a single multi-feed transceiver is configured to provide feed to both antennas. The phone chassis acts as a common ground plane for both antennas.

A method for tuning one or more antennas in a mobile radio device is also disclosed. The method in one embodiment comprises forming one or more slots within the antenna radiator element so as to increase the effective electric length of the radiator, and thus facilitate antenna tuning to the desired frequency of operation.

A method for matching a monopole antenna for operation in a lower frequency band is also disclosed. In one embodiment, the method comprises using a low-frequency matching circuit to improve antenna impedance matching and radiation efficiency.

Detailed Description Of Exemplary Embodiments

Detailed descriptions of the various embodiments and variants of the apparatus and methods of the invention are now provided. While primarily discussed in the context of mobile devices, the various apparatus and methodologies discussed herein are not so limited. In fact, many of the apparatus and methodologies described herein are useful in any number of complex antennas, whether associated with mobile or fixed location devices, that can benefit from the distributed antenna methodologies and apparatus described herein.

Exemplary Antenna Apparatus

Referring now to FIG. 2A through FIG. 8B, exemplary embodiments of the mobile radio antenna apparatus of the invention (and their associated performance) are described in detail.

It will be appreciated that while these exemplary embodiments of the antenna apparatus of the invention are implemented using a PIFA and a monopole antenna (selected in these embodiments for their desirable attributes and performance), the invention is in no way limited to PIFA and/or monopole antenna-based configurations, and in fact can be implemented using other technologies, such as patch or microstrip.

Figure 2A:
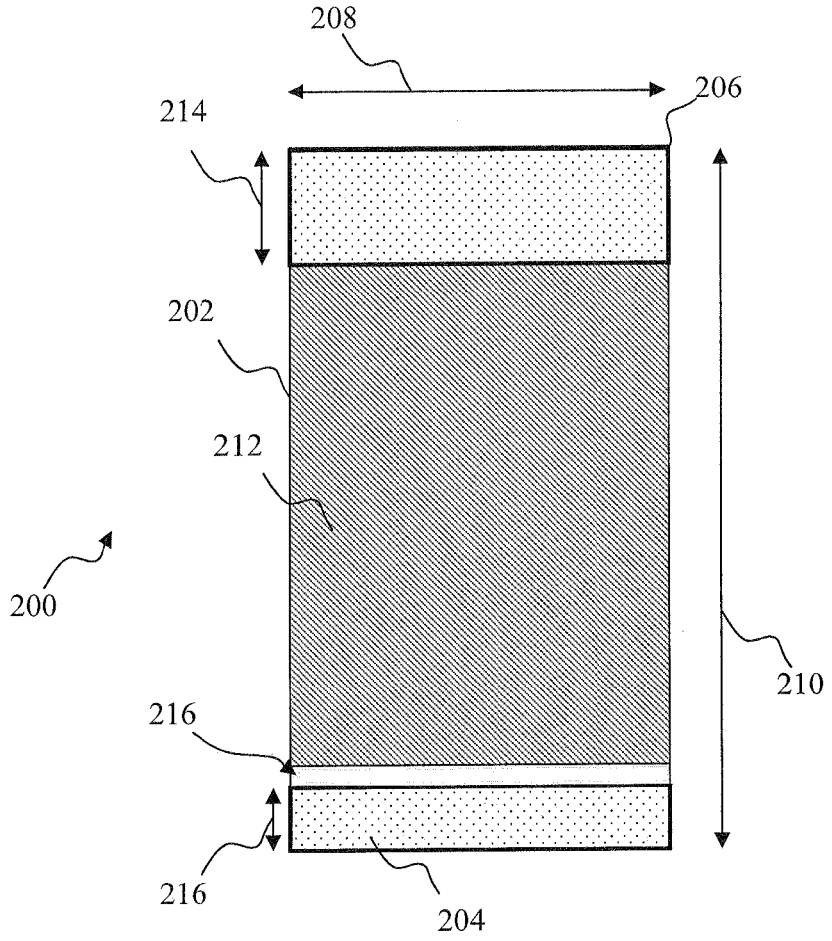
FIG. 2A is a top elevation view of a distributed antenna configuration in accordance with one embodiment of the present invention.

Referring now to FIG. 2A, one embodiment of a mobile radio device printed circuit board comprising (PCB) a distributed multiband antenna configuration is shown. The PCB 200 comprises a rectangular substrate element 202 having a width 208 and a length 210, with a conductive coating deposited on the front planar face of the substrate element, so as to form a ground plane 212. An inverted-F planar antenna 206 is disposed proximate to one (top) end of the PCB 200. The PIFA 206 is configured to operate in the upper frequency band (here, 1900 MHz), and has a width 214 and a length 208. A lower-band (here, 900 MHz) monopole antenna 204 is disposed proximate the opposite end of the PCB 200 from the PIFA element 206. The ground plane 212 extends from the top edge of the substrate to the bottom monopole 204. For optimal operation, the monopole antenna 204 requires a clearance area 216 from the ground plane.

Figure 2B:
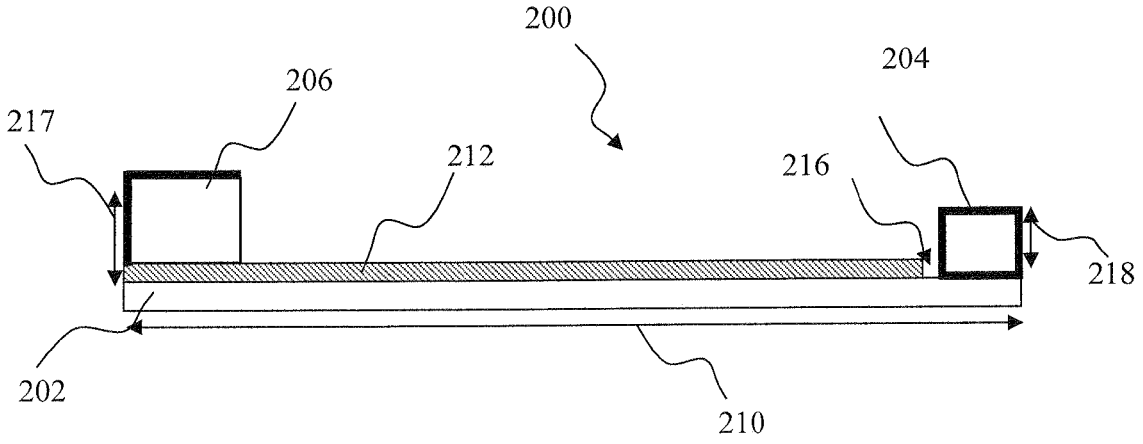
FIG. 2B is a side elevation view of antenna configuration of FIG. 2A.

FIG. 2B illustrates a side view of the distributed antenna configuration 200 of FIG. 2A taken along the line 2A-2A. The vertical dimension (height) 217 of the high-band PIFA element 206 and height 218 of the monopole antenna element 204, are also shown.

The exemplary PCB 200 of FIGS. 2A-2B comprises a rectangular shape of about 110 mm (4.3 in.) in length, and 50 mm (2.0 in.) in width. The dimensions of the exemplary antennas are as follows: the upper-band (PIFA) is 7 mm (0.3 in) high and 13 mm (0.5 in) wide, while the lower-band (monopole) is 6 mm (0.3 in) tall and 7 mm (0.3 in.) wide. As persons skilled in the art will appreciate, the dimensions given above may be modified as required by the particular application. While the majority of presently offered mobile phones and personal communication devices typically feature a bar (e.g., so-called "candy bar") or a flip configuration with a rectangular outline, there are other designs that utilize other shapes (such as e.g., the Nokia 77XX Twist™, which uses a substantially square shape). Advantageously, the antenna(s) of the invention can readily be adopted for even these non-traditional shapes.

Figure 2C:
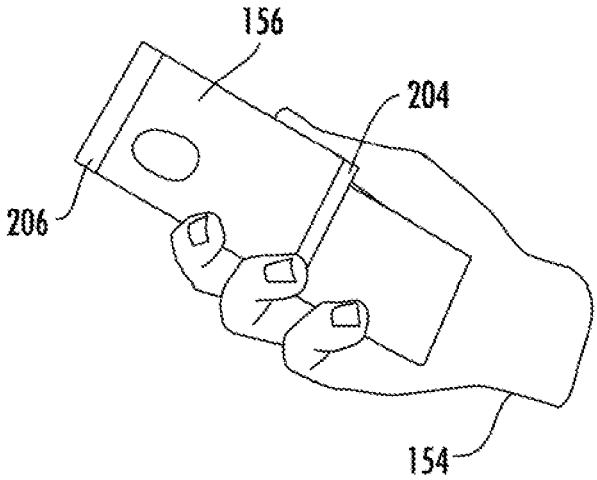
FIG. 2C is a graphical illustration of mobile telephone in accordance with a first embodiment of the present invention, positioned with respect to a CTIA hand phantom.

Referring now to FIG. 2C, a phantom hand CTIA test configuration is shown for a mobile radio device comprising a distributed antenna configuration according to the present invention. In the configuration shown in FIG. 2C, the high-band PIFA element 206 is advantageously spaced further from the hand phantom than prior art solutions, which improves antenna high-band performance. The low-band monopole element 204 is located proximate to the hand phantom 154. To compensate for potential degradation in antenna performance at lower frequencies due to proximity of external elements (such as the hand phantom), the antenna element 204 is outfitted with a matching circuit. Because the lower-band and the upper-band antenna elements are implemented separately (both mechanically and electrically separated from each other), the lower-band antenna matching only affects the low frequency portion, without affecting the operation of the high-frequency portion of the distributed antenna. In one embodiment, the electrical isolation between the lower-band and the upper-band antenna elements 204 and 206 is approximately 25 dB. This amount of isolation allows for better lower band and upper band antenna performance as the two antenna elements 204,206 are practically electrically independent from each other.

Using a distributed antenna configuration of the type described herein, the ground clearance area required for optimal antenna operation in lower frequency band (e.g., 900 MHz) can be in theory reduced. In an embodiment shown above in FIG. 2A the ground plane clearance is reduced from 10 mm to 7 mm, compared to having only a bottom mounted monopole antenna. Since the upper band antenna is moved to the other end region of the mobile device, the space that it occupied at the bottom end is available for other uses (or alternatively allows for a smaller device form factor in that area).

Figure 3A:
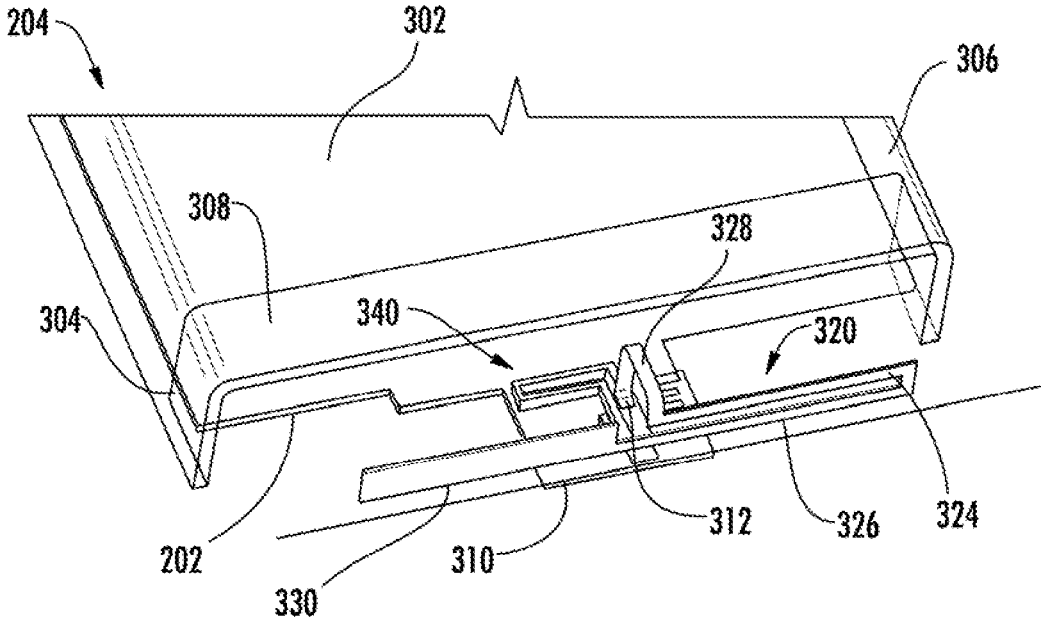
FIG. 3A is an isometric view of a section of a mobile phone, detailing a matched monopole low-band antenna structure in accordance with one embodiment of the present invention.
Figure 3B:
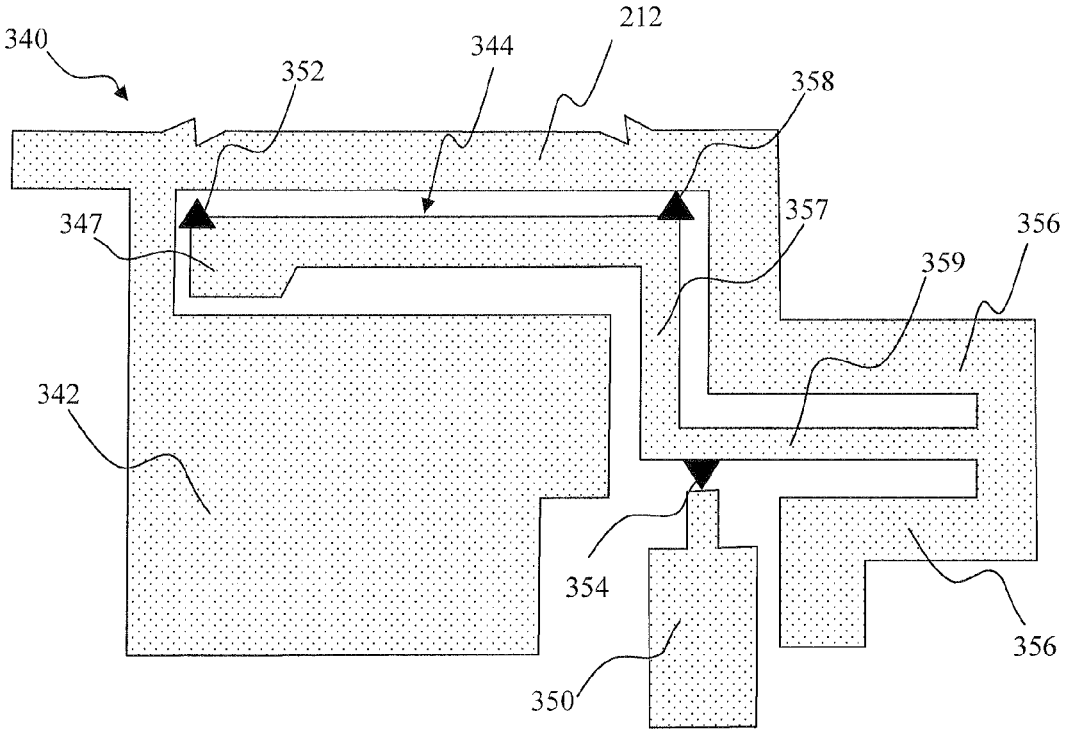
FIG. 3B is a top plan view of the low-band antenna structure of FIG. 3A.

The detailed structure of the lower-band antenna 204, configured in accordance with the principles of the present invention, is shown in FIGS. 3A-3C. FIG. 3A presents an isometric view of an exemplary mobile radio device bottom section, with monopole antenna revealed. The device cover 302 (fabricated from any suitable material such as plastic, metal, or metal-coated plastic) is shown as being transparent so as to reveal the underlying support members 304, 306, 308 of the mobile device body assembly. In one embodiment, the members 304, 306, 308 are fabricated from plastic while other suitable materials can be used as well, e.g., metal, or metal-coated polymer. The low-band antenna assembly 204 comprises monopole radiator structure 320, and the corresponding matching circuit 340.

The lower-band plane radiator element 320 is in the illustrated embodiment oriented perpendicular to the mobile device PCB substrate 202, and is electrically coupled to the circuit 340 via the feed point 312. The matching circuit 340 is fabricated directly on a lower portion 310 of the PCB substrate 202. In one variant, the lower portion 310 of the PCB substrate is dimensioned so as to match the outer dimensions of the matching circuit 320, as shown in FIG. 3A, although this is not a requirement for practicing the invention.

The lower-band monopole antenna comprises a rectangular radiator end portion 320 and a plurality of stripline radiator elements 324, 326, 328. The striplines sections 324, 326 are arranged to from a non-conductive slot in the radiator plane. This slot can be used to form a higher resonance mode, to same feed point as the low band resonance, if required. The radiator elements 330, 324, 326, 328 are configured to increase the antenna effective electric length so as to permit operation in the low frequency band (here, 850 and 900 MHz), while minimizing the physical size occupied by the antenna assembly. The antenna 320 radiator is electrically coupled to the mobile radio device transceiver via the feed point 312. In order to reduce the overall volume occupied by the lower-band antenna 204, the element 328 is bent to conform to the shape of a plastic support carrier (not shown) that is placed underneath antenna radiating element, as shown in FIG. 3A, when it is installed in the mobile radio device.

FIG. 3B depicts the detailed structure of the exemplary embodiment of the matching circuit 340 used in conjunction with the lower-band antenna element 320 to form the lower-band matching monopole antenna assembly. The purpose of the matching circuit is used to increase bottom mounted monopole impedance antenna bandwidth. The matching circuit 340 comprises a ground element 342, a stripline 344 formed between ground elements 342, 356 and the ground plane 212. In one embodiment, the stripline 344 comprises a nonrectangular structure 347, although other shapes may be used consistent with the invention. The stripline 344 is coupled to the feed electronics at the feed point 352, and coupled to ground via a tuning capacitive element 358. By appropriately positioning the capacitive element 358 and/or changing the capacitance value a precise antenna circuit resonance tuning is achieved.

In an alternate embodiment, the stripline 344 may comprise one or more bends configured to create segments 357, 359. Although segments 357,359 are shown to form at a right angle other mutual orientations are possible, as can be appreciated by these skilled in the art. The position of the bends and the length of elements 357, 359 are selected to alter the resonance length of the antenna as required for more precise matching to the desired frequency band of operation.

The matching circuit 340 is coupled to the low-band antenna radiator element 320 via a low-band feeding pad 350. The pad 350 is coupled from the stripline 344 via an inductive element 354. In one embodiment the inductive element 354 comprises a serial coil.

The matching circuit 340 forms a parallel LC circuit, wherein the inductance is formed by the stripline 344 connection to ground and the capacitance is determined by the stripline 344 size and capacitive element 358 (e.g., lumped). It is appreciated that while a single capacitive element 358 is shown in the embodiment of FIG. 3B, multiple (i.e., two or more) components arranged in an electrically equivalent configuration may be used consistent with the present invention. Moreover, other types of capacitive elements may be used, such as, discrete (e.g., plastic film, mica, glass, or paper) capacitors, or chip capacitors. Myriad other capacitor configurations useful with the invention exist.

In one embodiment, the matching circuit 340 is formed by depositing a conductive coating onto a PCB substrate, and subsequently etching the required pattern, as shown in FIG. 3B. Other fabrication methods are anticipated for use as well, such as forming a separate flex circuit and attaching it to the PCB substrate.

The matching circuit 340 inter alia, (i) enables precise tuning of the low band monopole antenna to the desired frequency band; and (ii) provides accurate impedance matching to the feed structure of the transceiver. This advantageously improves low band antenna performance in phantom tests, and enables better compliance with CTIA requirements.

Figure 4A:
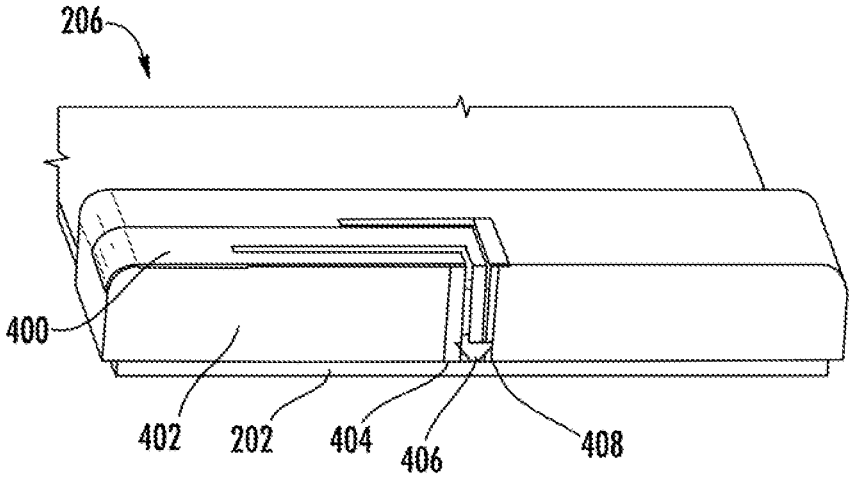
FIG. 4A is an isometric of a mobile phone, detailing a high-band PIFA antenna in accordance with another embodiment of the present invention.

Referring now to FIG. 4A, the structure of one embodiment of the high-band planar inverted-F antenna element 206 is shown in detail. The high-band PIFA comprises planar radiating structure 400 deposited onto the substrate 402. The PIFA structure 206 is coupled to the ground plane at three points: the main high-band feed 406, the parasitic feed 408, and the ground point 404.

Figure 4B:
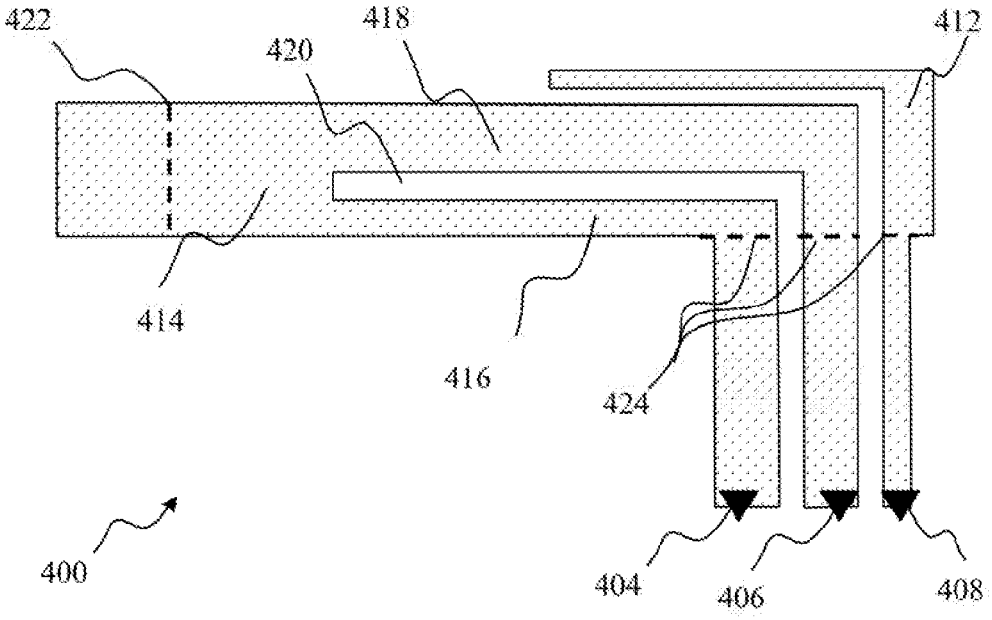
FIG. 4B is a top plan view of the PIFA antenna structure of FIG. 4A.

The exemplary PIFA planar element 400, shown in detail in FIG. 4B, comprises primary rectangular radiator portion 414, parasitic radiator 412, and a slot 420 formed between two lateral members of the radiator structure 416, 418.

In one embodiment, in order to reduce the overall volume occupied by the high-band antenna 206, the PIFA structure 400 is routed or bent along the lines 422, 424 so as to conform to the shape of the underlying substrate when installed in the mobile radio device, as shown in FIG. 4A.

In another embodiment, the PIFA structure 400 is formed by depositing a conductive coating onto the PCB substrate 402 and subsequently etching the pattern shown in FIG. 4A. Other fabrications methods are anticipated for use as well, such as forming a separate flex circuit and attaching it to the PCB substrate.

In one embodiment, the lower frequency band comprises a sub-GHz Global System for Mobile Communications (GSM)

band (e.g., GSM710, GSM750, GSM850, GSM810, GSM900), while the higher band comprises a GSM1900, GSM1800, or PCS-1900 frequency band (e.g., 1.8 or 1.9 GHz).

In another embodiment, the low or high band comprises the Global Positioning System (GPS) frequency band, and the antenna is used for receiving GPS position signals for decoding by e.g., an internal receiver.

In another variant, the high-band comprises a WiFi or Bluetooth frequency band (e.g., approximately 2.4 GHz), and the lower band comprises GSM1900, GSM1800, or PCS1900 frequency band. As persons skilled in the art will appreciate, the frequency band composition given above may be modified as required by the particular application(s) desired. Moreover, the present invention contemplates yet additional antenna structures within a common device (e.g., tri-band or quad-band) where sufficient space and separation exists.

Performance

Referring now to FIGS. 5 through 8B, performance results of an exemplary distributed antenna constructed in accordance with the principles of the present invention are presented.

Figure 5:
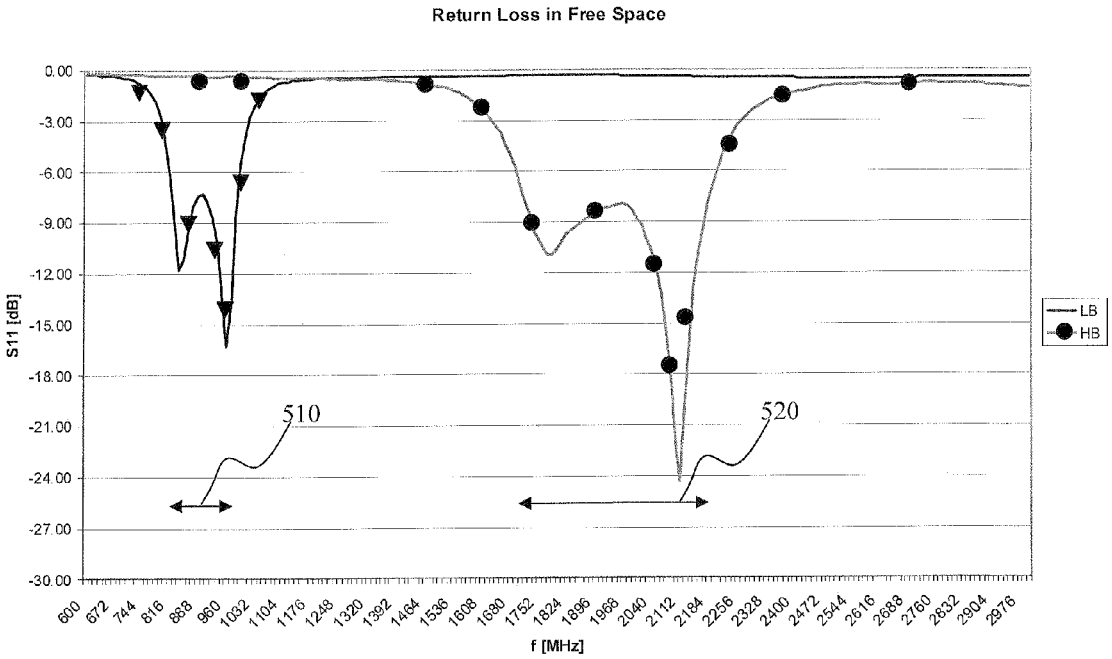
FIG. 5 is a plot of measured free space input return loss for various exemplary low-band and high-band antenna configurations according to the present invention.

FIG. 5 shows a plot of free-space return loss S11 (in dB) as a function of frequency, measured with: (i) the lower-band antenna constructed in accordance with the embodiment depicted in FIG. 3A 204, and (ii) the upper-band antenna 206 constructed in accordance with the embodiment depicted FIG. 4A 206. The vertical lines of FIG. 5 denote the low band 510 and the high frequency band 520, respectively. Comparing the free space loss measured in the two frequency bands of interest, the upper-band antenna exhibits higher losses compared to the lower band, as expected.

Figure 6A:
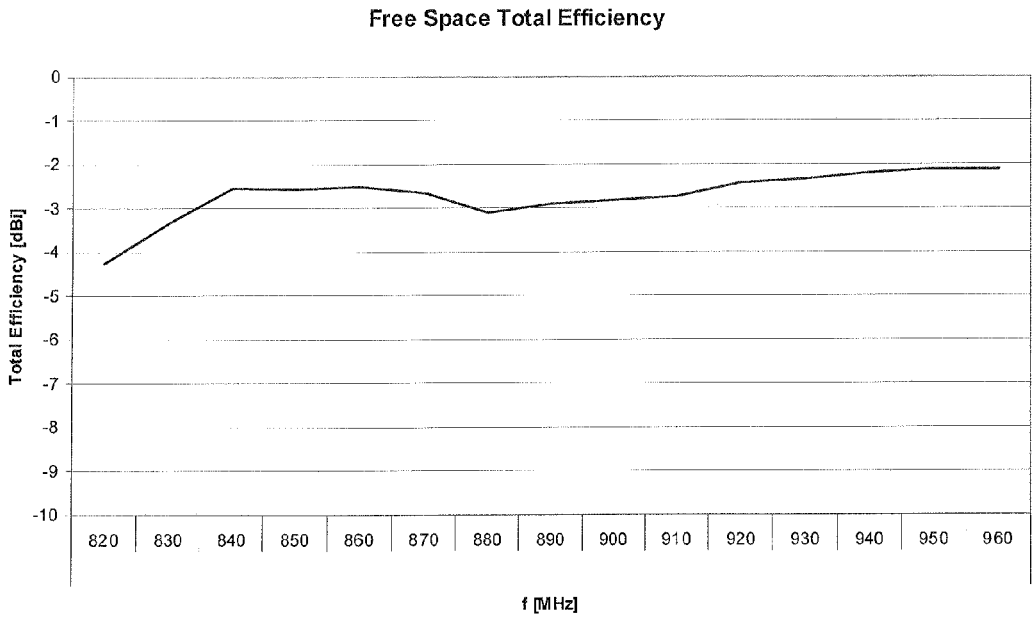
FIG. 6A is a plot of measured free space efficiency for the low-band matched monopole antenna configuration of FIG. 3B.
Figure 6B:
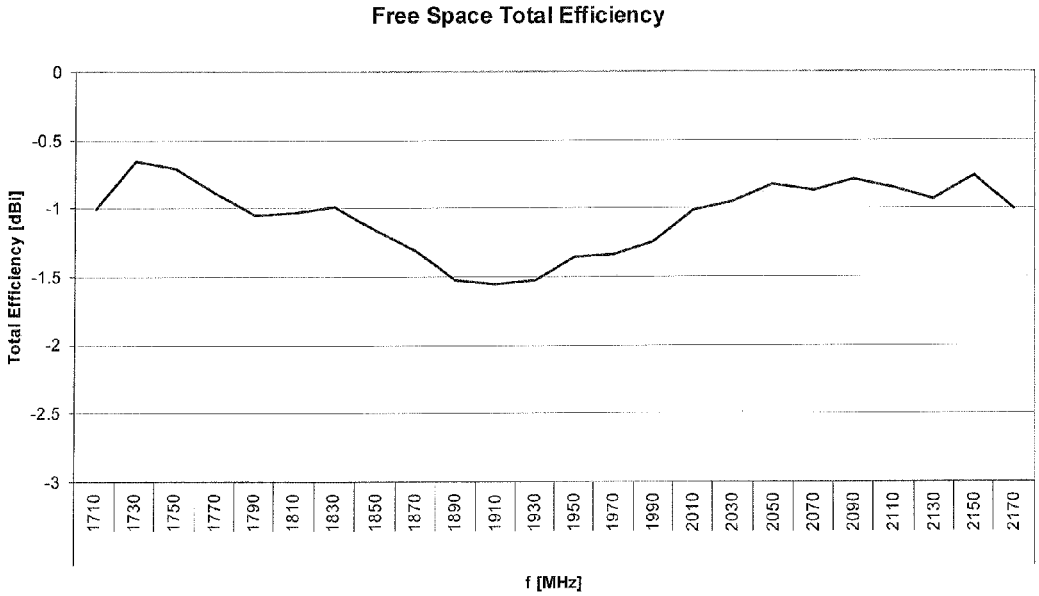
FIG. 6B is a plot of measured free space efficiency for the high-band PIFA antenna configuration of FIG. 4B.

FIGS. 6A and 6B show data regarding measured free-space efficiency for the same two antennas as described above with respect to FIG. 5. The antenna efficiency (in dB) is defined as decimal logarithm of a ratio of radiated and input power:

$$AntennaEfficiency = 10\log_{10}\left(\frac{\text{Radiated Power}}{\text{Input Power}}\right) \quad \text{Eqn. (3)}$$

An efficiency of zero (0) dB corresponds to an ideal theoretical radiator, wherein all of the input power is radiated in the form of electromagnetic energy. The data in FIG. 6A demonstrate that the low-band monopole antenna of the invention achieves a total efficiency between −4 and −2 dB. The data in FIG. 6B, obtained with the high-band antenna, shows higher efficiency (between −1.5 and −0.5 dB) when compared to the low band data of FIG. 6A. Overall, the antenna embodiment of the present invention exhibits similar free-space performance, compared to a prior art design that uses a bottom-mounted monopole. The free-space efficiency describes the upper efficiency limit of the specific antenna, as it is achieved in the environment that is free from any interference that could potentially degrade antenna performance.

Figure 1C:
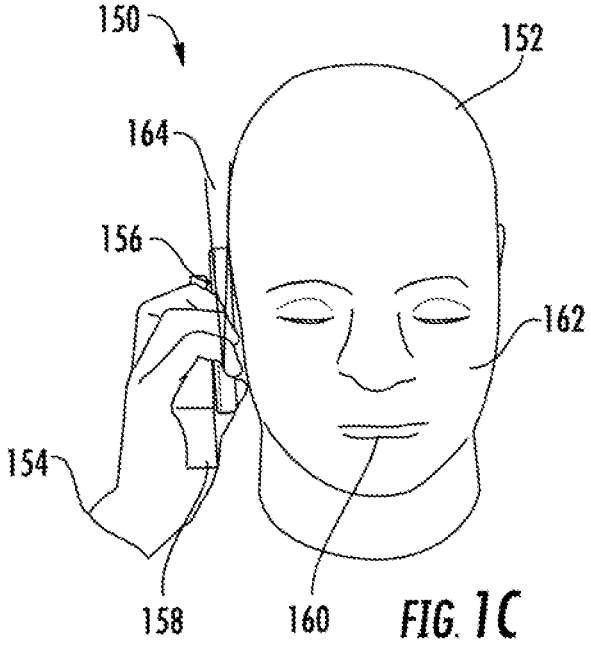
FIG. 1C PRIOR ART
FIG. 1C is a graphical illustration of a typical prior art CTIA 3.0 compliance measurement setup, depicting positioning of the unit under test with respect to the head phantom.
Figure 1D:
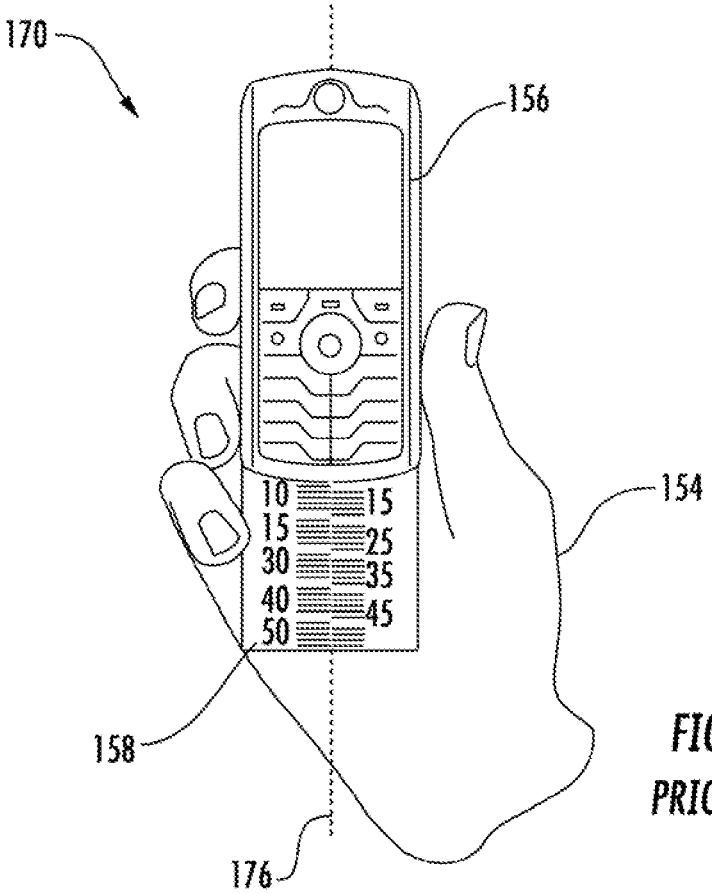
FIG. 1D PRIOR ART
FIG. 1D is a graphical illustration of a typical prior art CTIA 3.0 measurement setup, depicting unit under test positioning with respect to the hand phantom.
Figure 7A:
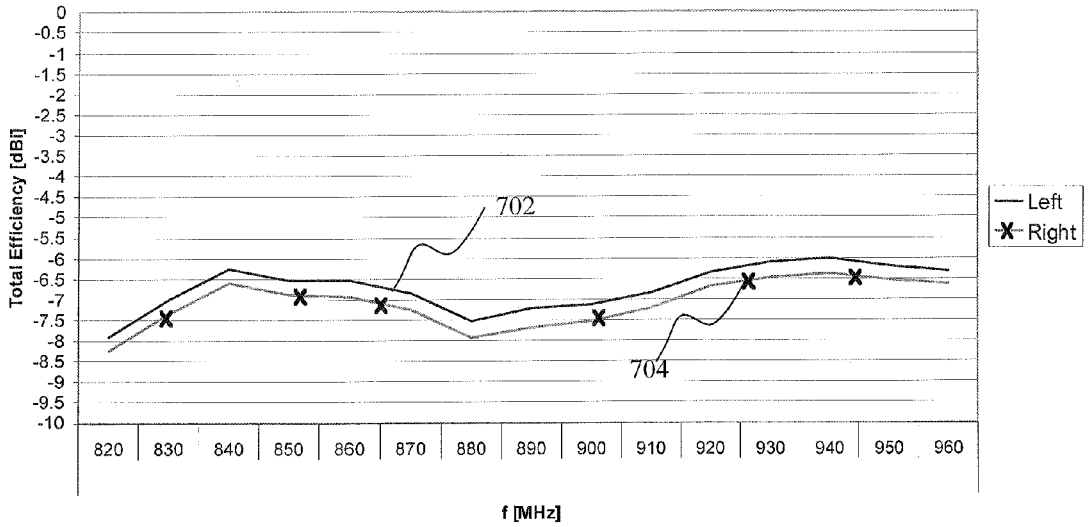
FIG. 7A is a plot of total efficiency (measured in the high-frequency band proximate to a head phantom) for the low-band matched monopole antenna configuration of FIG. 3B.
Figure 7B:
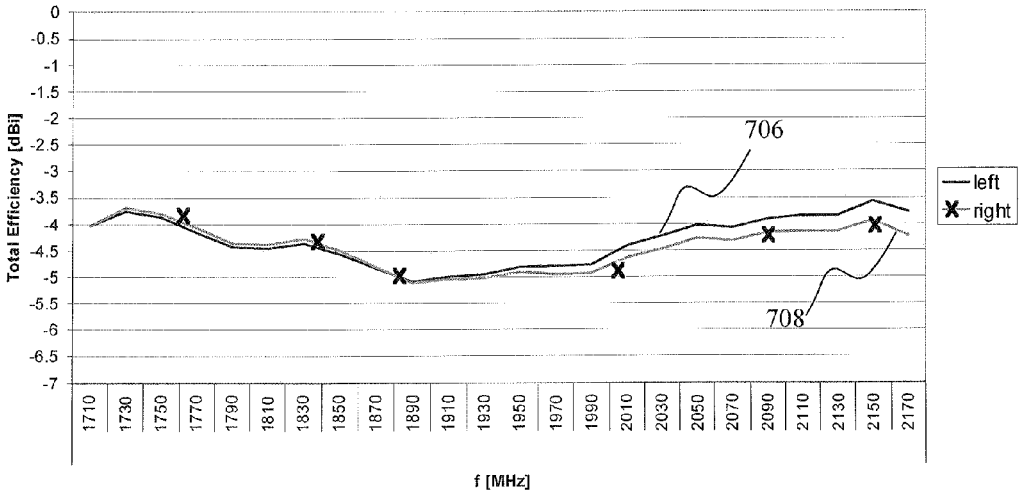
FIG. 7B is a plot of total efficiency (measured in the high-frequency band proximate to a head phantom) for the high-band PIFA antenna configuration of FIG. 4B.

FIG. 7A and FIG. 7B present total efficiency data for the low band and high band antennas described above with respect to FIG. 5. The data presented in FIG. 7A and FIG. 7B are obtained proximate to the head phantom as mandated by the CTIA 3.0 regulations (see FIG. 1C above). The measurement results shown in FIG. 7A and FIG. 7B were obtained on both right and left sides of the head phantom. The curves 702, 706 correspond to the right side measurements; while the curves 704, 708 correspond to the left side measurements.

The lower-band efficiency data presented in FIG. 7A show slightly reduced antenna efficiency (by about 0.3 dB) measured on the right side across the whole lower frequency band, when compared to the left side measurements. The upper-band efficiency data presented in FIG. 7B show a very similar efficiency numbers measured on both the left and the right sides of the head phantom.

Figure 8A:
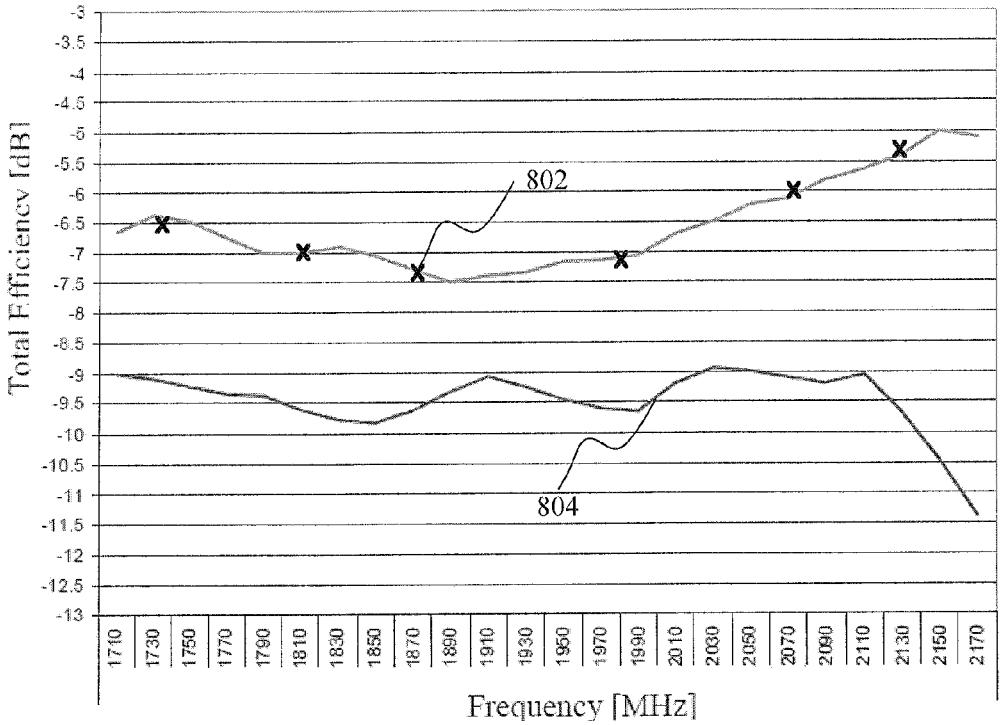
FIG. 8A is a plot of total efficiency (measured in the high-frequency band proximate to head and hand phantoms) for the following antenna configurations: (i) the distributed antenna configuration of FIG. 2A; and (ii) a typical prior art bottom mounted monopole antenna.
Figure 8B:
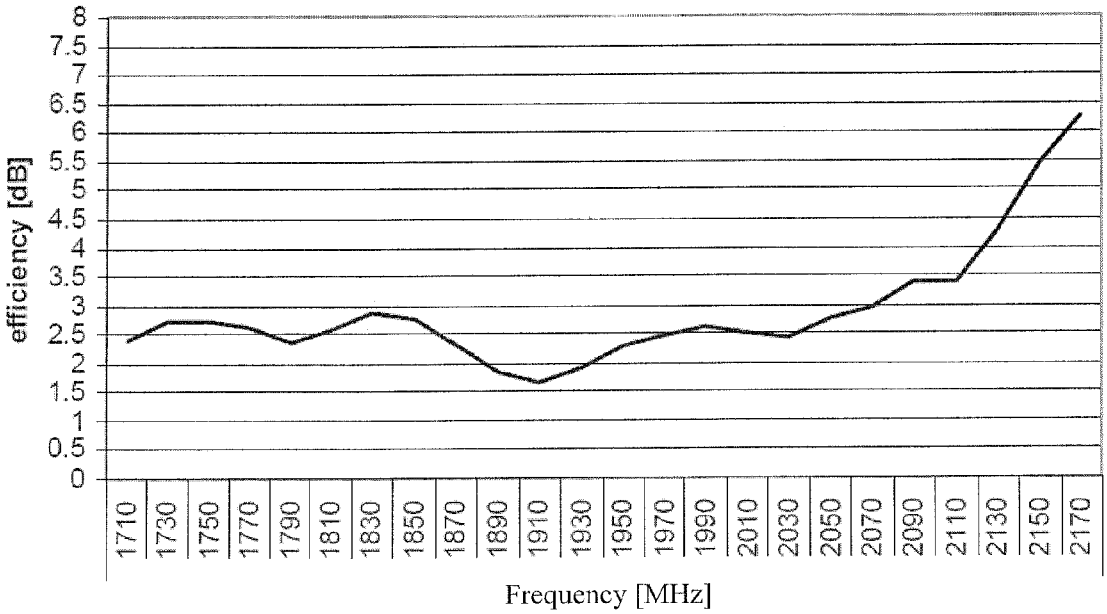
FIG. 8B is a plot of measured figure-of-merit (FOM) of the distributed antenna configuration of FIG. 2A, as compared with a typical prior art bottom mounted monopole antenna.

Referring now to FIG. 8A, the total efficiency measured in the high-frequency band proximate to the head and hand phantoms is shown for the following antenna configurations: (i) a distributed antenna configuration 200 of FIG. 2A 802; and (ii) bottom mounted monopole antenna according to the prior 804. FIG. 8B shows the difference dE between the efficiency measurements for the two antenna configurations described above with respect to FIG. 8A. Positive values of dE correspond to higher efficiency achieved with the distributed antenna configured in accordance with the present invention.

The data shown in FIG. 8B clearly demonstrate higher efficiency (between 2.5 and 6 dB) achieved with the distributed antenna proximate to the head and hand phantom when compared to the prior art design. This represents between 70 and 300% of additional power that is radiated (or received) by the distributed antenna compared to the prior art design. This increased efficiency can have profound implications for, inter alia, mobile devices with finite power sources (e.g., batteries), since appreciably less electrical power is required to produce the same radiated output energy. In addition, SAR compliance is easier to achieve, as a lower transmission power can be used with a more efficient antenna design (e.g., that shown in FIG. 4A-4B above).

Advantageously, the use of two separate antenna configurations for the upper (PIFA) and lower (matched monopole) bands as in the illustrated embodiments allows for optimization of antenna operation in each of the frequency bands independently from each other. The use high-frequency PIFA reduces the overall antenna assembly volume and height, compared to a single dual-band PIFA, and therefore enables a smaller and thinner mobile device structure. In addition, the use of a PIFA reduces signal loss and interference at higher frequencies when operating in proximity to the head and hand phantoms. Utilization of a monopole antenna, matched to operate in the lower frequency band, improves device performance when operating in the proximity to the head and hand phantoms as well. These, in turn, facilitate compliance with the CTIA regulations, with all of the foregoing attendant benefits.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A multiband antenna assembly comprising a lower and an upper operating frequency band, the multiband antenna assembly for use in a mobile radio device, the multiband antenna assembly comprising:

a substrate element comprised of a first end and a second opposing end, the substrate element comprising a conductive coating disposed thereon to form a ground plane, the conductive coating substantially covering the substrate element and extending from the first end towards the second opposing end, a portion of the second opposing end is exposed to form a clearance area without the conductive coating disposed thereon;

a planar inverted-F antenna (PIFA) element configured to operate in the upper frequency band and being disposed above the ground plane and proximate to the first end of the substrate element;

a monopole antenna configured to operate in the lower frequency band and being disposed proximate to the clearance area of the second opposing end, the clearance area configured to provide electrical isolation of the monopole antenna from the PIFA element, and further configured to reduce a ground plane clearance; and a feed apparatus configured to feed the monopole antenna and the PIFA element;

wherein the monopole antenna further comprises:

a radiator element formed in a plane substantially perpendicular to the ground plane; and a non-conductive slot formed within the radiator element; and a matching circuit comprising:

a feed point;

a ground;

a stripline coupled from the ground to the feed point;

a tuning capacitor coupled to the ground and the stripline; and a feed pad coupled to the stripline via an inductor; and wherein the feed pad is further coupled to the radiator element;

wherein the PIFA element further comprises:

a first planar radiator formed substantially parallel to the ground plane;

a parasitic planar radiator formed substantially coplanar to the first planar radiator;

a non-conductive slot formed within the first planar radiator;

a first feed point configured to couple the first planar radiator to the feed apparatus;

a ground point configured to couple the first planar radiator to the ground plane; and a parasitic feed point configured to couple the parasitic planar radiator to the ground plane wherein a total efficiency for the multiband antenna assembly disposed proximate a head and a hand phantom is greater than 2.5 dB better in the upper frequency band as compared with a bottom mounted monopole antenna.

2. The antenna assembly of claim 1, wherein a center frequency of the lower frequency band is below 1600 MHz and a center frequency of the upper frequency band is above 1700 MHz.

3. The antenna assembly of claim 2, wherein the lower frequency band further comprises a global system for mobile communications (GSM) 900 band and the upper frequency band comprises a GSM1800 band.

4. The antenna assembly of claim 3, wherein the lower frequency band comprises a global positioning system (GPS) band and the upper frequency band comprises a GSM1900 frequency band.

5. A multiband antenna apparatus comprising a lower and an upper operating frequency band, the multiband antenna apparatus for use in a mobile radio device, the multiband antenna apparatus comprising:

a substrate element configured to have a first end and a second opposing end, the substrate element configured to have a conductive coating disposed thereon to form a ground plane, the conductive coating substantially covering the substrate element and extending from the first end towards the second opposing end, a portion of the second opposing end being exposed so as to form a clearance area not having the conductive coating disposed thereon;

a first antenna assembly configured to operate in the upper operating frequency band, the first antenna assembly comprising a planar inverted-F antenna (PIFA) disposed above the ground plane and proximate to the first end of the substrate element;

a second antenna assembly configured to operate in the lower operating frequency band, the second antenna assembly comprising a monopole antenna coupled to a matching circuit configured to increase an impedance bandwidth of the monopole antenna, the second antenna assembly disposed proximate to the clearance area of the second opposing end, the clearance area configured to provide electrical isolation of the second antenna assembly from the first antenna apparatus thereby improving performance of the lower and upper operating frequency bands; and a feed apparatus configured to feed one or more of the first and second antenna assemblies;

wherein the monopole antenna further comprises a radiator element with a non-conductive slot formed therein, the radiator element disposed in a plane substantially perpendicular to the ground plane;

wherein the PIFA further comprises a first planar radiator formed substantially parallel to the ground plane, a parasitic planar radiator formed substantially coplanar to the first planar radiator, and a non-conductive slot formed within the first planar radiator; and wherein a total efficiency for the multiband antenna apparatus is better than −8.5 dB from 1710 MHz to 2170 MHz.

6. The multiband antenna apparatus of claim 5, wherein the matching circuit further comprises:

a feed point;

a ground;

a stripline coupled from the ground to the feed point;

a tuning capacitor coupled to the ground and the stripline; and a feed pad coupled to the stripline via an inductor, and the feed pad is further coupled to the radiator element.

7. The multiband antenna apparatus of claim 6, wherein the monopole antenna further comprises:

a capacitive element coupled between the ground and the stripline;

wherein the feed pad is further coupled to the radiator element.

8. The multiband antenna apparatus of claim 5, wherein the PIFA further comprises:

a first feed point coupled from the first planar radiator to the feed apparatus;

a ground point coupled to the first planar radiator and the ground plane; and a parasitic feed point coupled to the parasitic planar radiator and the ground plane.

9. The multiband antenna apparatus of claim 5, wherein a center frequency of the lower operating frequency band is below 1600 MHz and a center frequency of the upper operating frequency band is above 1700 MHz.

10. The multiband antenna apparatus of claim 5, wherein a center of the lower operating frequency band further comprises a global system for mobile communications (GSM) 900 band and the upper operating frequency band comprises a GSM1800 band.

11. The multiband antenna apparatus of claim 5, wherein the lower operating frequency band comprises a global positioning system (GPS) band and the upper operating frequency band comprises a GSM1900 frequency band.

12. A distributed multiband antenna apparatus comprising a lower operating frequency band and an upper operating frequency band, the distributed multiband antenna apparatus for use in a mobile radio device, the distributed multiband antenna apparatus comprising:

a substrate element configured to have a conductive coating disposed thereon to form a ground plane substantially covering the substrate element, the ground plane extending from a first end of the substrate element towards a second opposing end of the substrate element, and a clearance area formed at the second opposing end characterized in that the clearance area does not have the conductive coating disposed thereon;

a first antenna assembly configured to operate in the upper operating frequency band, the first antenna assembly disposed above the ground plane and proximate to the first end of the substrate element; and a second antenna assembly configured to operate in the lower operating frequency band, the second antenna assembly coupled to a matching circuit configured to increase an impedance bandwidth of the second antenna assembly, the second antenna assembly disposed proximate to the clearance area of the second opposing end, the clearance area configured to provide electrical isolation of the second antenna apparatus from the first antenna assembly thereby improving performance of the lower and upper operating frequency bands;

wherein an efficiency for the distributed multiband antenna apparatus is between 2.5 dB and 6 dB better than a bottom mounted monopole antenna for at least a portion of the upper operating frequency band when the distributed multiband antenna apparatus is placed proximate to a head and a hand phantom.

13. The distributed multiband antenna apparatus of claim 12, wherein the first antenna assembly comprises a PIFA structure.

14. The distributed multiband antenna apparatus of claim 13, wherein the PIFA further comprises a first planar radiator formed substantially parallel to the ground plane, a parasitic planar radiator formed substantially coplanar to the first planar radiator, and a non-conductive slot formed within the first planar radiator.

15. The distributed multiband apparatus of claim 14, wherein the PIFA further comprises:

a first feed point coupled from the first planar radiator element to the feed apparatus;

a ground point coupled to the first planar radiator and the ground plane; and a parasitic feed point coupled to the parasitic planar radiator and the ground plane.

16. The distributed multiband antenna apparatus of claim 12, wherein the second antenna assembly comprises a monopole antenna coupled to the matching circuit.

17. The distributed multiband antenna apparatus of claim 16, wherein the monopole antenna further comprises a radiator element with a non-conductive slot formed therein, the radiator element disposed in a plane substantially perpendicular to the ground plane.

18. The distributed multiband antenna apparatus of claim 16, wherein the matching circuit further comprises:

a feed point;

a ground;

a stripline coupled from the ground to the feed point;

a tuning capacitor coupled to the ground and the stripline; and a feed pad coupled to the stripline via an inductor, with the feed pad being further coupled to a radiator element.

19. The distributed multiband antenna apparatus of claim 18, wherein the monopole antenna further comprises:

a capacitive element coupled between the ground and the stripline;

wherein the feed pad is further coupled to the radiator element; and wherein the radiator element is disposed in a plane substantially perpendicular to the ground plane.

20. The distributed multiband antenna apparatus of claim 19, wherein the capacitive element is configured to effect tuning of antenna resonance to the lower operating frequency band.

21. The distributed multiband antenna apparatus of claim 12, wherein the lower operating frequency band comprises a global positioning system (GPS) band and the upper operating frequency band comprises a GSM1900 MHz frequency band.

22. The distributed multiband antenna apparatus of claim 12, wherein a center frequency of the lower operating frequency is below 1600 MHz, and a center frequency of the upper operating frequency band is above 1700 MHz.

23. The distributed multiband antenna apparatus of claim 12, wherein a center of the lower operating frequency band comprises a Global System for Mobile Communications (GSM) 900 MHz band, and the upper operating frequency band comprises a GSM1800 MHz band.

24. The distributed multiband antenna apparatus of claim 12, wherein the lower operating frequency band comprises a Global Positioning System (GPS) band, and the upper operating frequency band comprises a WLAN frequency band of approximately 2.4 GHz.

* * * * *